United States Patent [19]

Strauss et al.

[11] Patent Number: 5,050,406

[45] Date of Patent: Sep. 24, 1991

[54] FABRIC FOR RECREATIONAL CLOTHING

[75] Inventors: Isidore Strauss, Clark, N.J.; Sam A. Rankin, Jr., Ashboro, N.C.

[73] Assignee: Miller Harness Company, Inc., East Rutherford, N.J.

[21] Appl. No.: 271,630

[22] Filed: Nov. 15, 1988

[51] Int. Cl.[5] ..... D04B 9/08; D04B 1/14

[52] U.S. Cl. ..... 66/177; 66/197; 66/202

[58] Field of Search ..... 66/196, 202, 197, 177; 57/225

[56] References Cited

U.S. PATENT DOCUMENTS

| | | | |
|---|---|---|---|
| 853,667 | 5/1907 | Williams | 66/196 |
| 3,234,724 | 2/1966 | Storti | 57/225 |
| 3,309,863 | 3/1967 | Hermes | 57/225 X |
| 3,315,328 | 4/1967 | Ibrahim | 57/225 |
| 4,062,204 | 12/1977 | Segundo et al. | 66/196 |

FOREIGN PATENT DOCUMENTS

| | | | |
|---|---|---|---|
| 2713539 | 9/1978 | Fed. Rep. of Germany | 66/197 |
| 629257 | 10/1978 | U.S.S.R. | 66/197 |
| 370761 | 4/1932 | United Kingdom | 66/202 |
| 411269 | 6/1934 | United Kingdom . | |
| 460601 | 2/1937 | United Kingdom . | |
| 916991 | 1/1963 | United Kingdom . | |
| 1355351 | 6/1974 | United Kingdom | 66/196 |

OTHER PUBLICATIONS

Textured Yarn Technology, vol. I, G. D. Wilkinson, Monsanto Co., 1967, pp. 351 through 361.

Reichman, "Knitting Encyclopedia", 1972 Knitted Outerwear Assoc., pp. 261-262.

*Primary Examiner*—Wm. Carter Reynolds

*Attorney, Agent, or Firm*—Lerner, David, Littenberg, Krumholz & Mentlik

[57] ABSTRACT

A knit fabric is made of a combination of a corespun yarn having a core of a resilient continuous filament yarn covered by a cotton fiber and a cotton yarn. These yarns are knit together in such a manner that one side of the knit fabric exposes only one of the yarns while the other side of the knit fabric exposes the knit combination of both yarns. The knit fabric is easily and comfortably manipulated while posessessing improved mechanical properties such as strength, durability, and stretch and recovery.

43 Claims, 3 Drawing Sheets

FABRIC FOR RECREATIONAL CLOTHING

BACKGROUND OF THE INVENTION

The present invention relates generally to fabrics for clothing, and more particularly to fabrics for recreational clothing in which an individual participates in vigorous recreational activities.

Apparel for recreational activities ranging from mountain climbing to various contact and non-contact sports require a considerable degree of strength and durability. Normally, it is the pants worn by an individual engaged in athletic activities which undergo the most manipulation as the legs are bent or otherwise moved and the muscles of the legs are flexed during such movement. Thus, in addition to requirements of strength and durability, there is an additional requirement that pants and other apparel possess a significant degree of stretch and recovery or "power" so that the pants or other apparel are easily manipulated by a participant in athletic activities. It is also preferred that the material or fabric of which the apparel is made be comfortable next to the skin of the participant. For instance, the riding pants for a jockey of a horse must provide a tight, smooth fit on the jockey's legs so as to reduce wind resistance and avoid the hindrance of loose material while riding a horse in a race.

Thus, the requisite characteristics of apparel such as riding pants include strength, durability, stretch and recovery, and comfort. In an attempt to fulfill these requirements, fabrics made of nylon, polyester, spandex or combinations of these yarns have been employed in recreational apparel such as riding pants for jockeys. These yarns are all synthetic, the spandex yarn having resilient properties superior to natural latex as well as nylon or polyester. Some of these fabrics provide the strength, durability, and stretch and recovery which might be required in particular articles of apparel, however, they are often uncomfortable next to the skin of a participant, especially in the case of riding pants which are tight fitting since such fabrics tend to be abrasive to the skin. Such fabrics become even more uncomfortable when a participant perspires since they do not possess absorbent characteristics. Further, these fabrics do not provide an acceptable aesthetic appearance unless the particular yarns used are of an extremely high quality.

Moreover, from the standpoint of manufacturing, the yarns of which these fabrics are made must undergo a relativley expensive dyeing process. Nylon, spandex and polyester require a "union dye" process whereby any fabric made from a combination of these yarns could not be dyed as a whole, but instead the yarns of the combination had to be dyed separately. In contrast, materials made from different cotton yarns could be dyed by a relatively simple dyeing process in which the fabric as a whole can be dyed inexpensively.

Inasmuch as cotton fibers are comfortable next to the skin of a participant, possess adsorbent characteristics, and can be dyed by a relatively inexpensive dyeing process, knit fabrics made from a combination of nylon, spandex or polyester and cotton have been proposed. Most such combinations were unsuccessful since the strength, durability, and stretch and recovery characteristics of the resultant fabric were inhibited by the cotton yarn unless a very small percentage of cotton was utilized. Fabrics made from such combinations were also lacking in aesthetic appearance. Moreover, it was also found that the better combinations of these yarns, such as bare cotton combined with spandex, were not only uncomfortable next to the skin but were easily destroyed since the fibers of the synthetic material which provides the requisite resilient properties would cut through the cotton fibers.

It is also noted that some woven fabrics made with nylon, polyester, spandex, cotton or combinations thereof have a great degree of strength and durability. Woven fabrics are produced by interlacing two or more sets of yarns or fibers so that the yarns pass each other essentially at right angles and one set of yarns is parallel to the fabric axis. This process is relatively expensive as compared to a knitting process in which one or more ends of a yarn are interlooped. Further, most such woven fabrics lack the power and comfort required of apparel such as riding pants for jockeys.

Thus, the foregoing demonstrates that a knit fabric particularly suited for recreational apparel, that is, possessing all of the above discussed properties and characteristics, is warranted. While others have failed to provide a fabric with a suitable combination of natural and synthetic yarns which includes the requisite properties and characteristics, the present invention provides a particularly structured combination of yarns so as to yield a fabric possessing all desirable properties and characteristics.

SUMMARY OF THE INVENTION

The present invention specifically relates to a fabric for recreational clothing which provides a relatively high degree of strength, durability, and stretch and recovery, and is comfortably worn next to the skin of a participant as well as providing a pleasant aesthetic appearance. The fabric of the present invention includes a large percentage of cotton yarn along with a corespun yarn. This corespun yarn is comprised of a spandex core so as to impart resilient properties to the yarn, and cotton fiber spun about the core so that the core is not exposed. The corespun yarn and cotton yarn are stitched in accordance with a Swiss or French pique, basket-weave or any other suitable stitch so that only the cotton yarn is exposed on one side of the knitted fabric and a combination of the corespun yarn and the cotton yarn is exposed on the opposite side of the fabric, whereby the large percentage of cotton fiber renders the fabric dyeable and comfortable while the core of the corespun yarn provides a high degree of strength and power. Thus, recreational apparel made with the fabric of the present invention is easily and comfortably manipulated by a participant wearing the same.

Accordingly, it is an object of the present invention to provide a knit fabric suitable for use in virtually any type of recreational clothing requiring strength, durability, power and comfort.

It is an object of the present invention to provide a knit fabric suitable for use in virtually any type of recreational activity where the fabric possesses the aforementioned properties and characteristics while also possessing a high percentage of cotton.

It is an object of the present invention to provide a knit fabric suitable for virtually any type of recreational clothing possessing the aforementioned properties and characteristics as well as possessing a pleasant aesthetic appearance.

It is an object of the present invention to provide a knit fabric for virtually any type of recreational clothing comprised of a combination of yarns which can be knitted by any one of a number of known stitches to provide the aforementioned properties and characteristics.

BRIEF DESCRIPTION OF THE DRAWINGS

The above and other objects of the present invention will become apparent, as will a better understanding of the concepts underlying the present invention, by reference to the description which follows when taken in conjunction with the accompanying drawings in which an example of a fabric made in accordance with the present invention is depicted.

DETAILED DESCRIPTION

Figure 1:
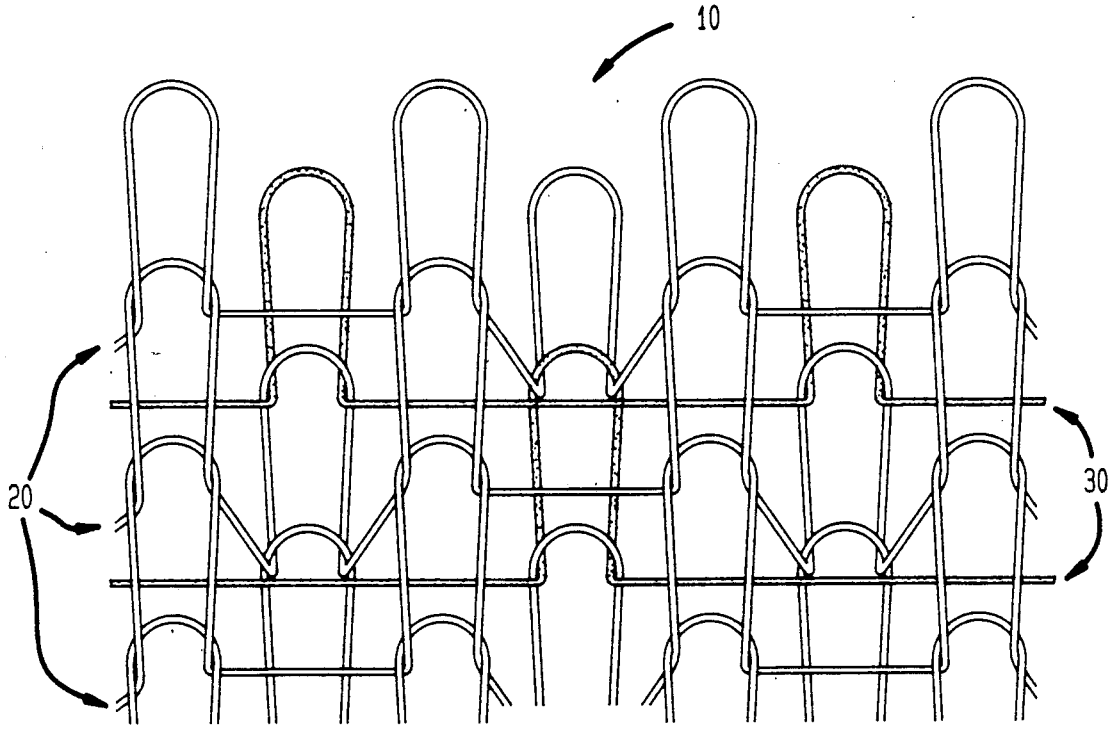
FIG. 1 is a schematic of a fabric made with the combination of yarns in accordance with the present invention and knit with the Swiss Pique stitch, the knit being illustrated in loose configuration, i.e., prior to the tightening of the yarns.
Figure 2:
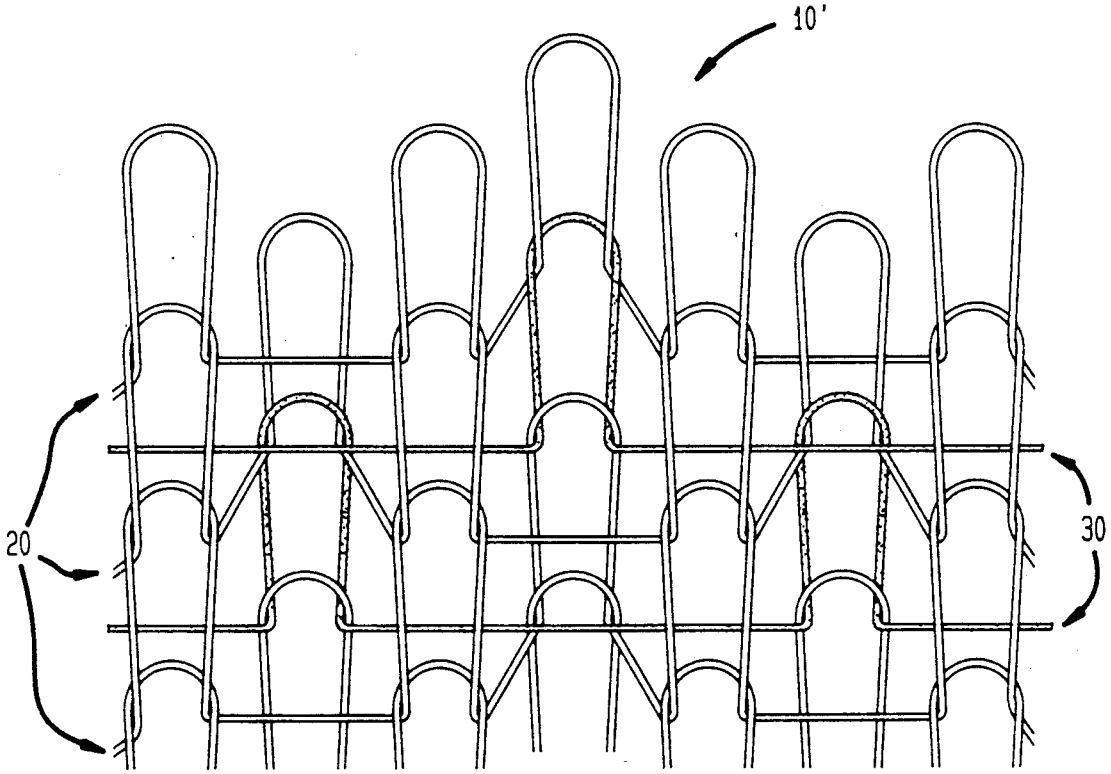
FIG. 2 is a schematic of a fabric made with the combination of yarns in accordance with the present invention and knit with the French Pique stitch, the knit being illustrated in loose configuration for clarity, i.e., prior to the tightening of the yarns.

The fabric in accordance with the present invention is made of a combination of two yarns which are knit together in such a manner that one side of the fabric exposes only one of the yarns while the other side of the fabric exposes the knit combination of both yarns. Any suitable stitch can be employed to yield the specific structure of the fabric, but the Swiss or French Pique stitches are preferred. An example of the fabric of the present invention as stitched by the Swiss Pique stitch is shown in FIG. 1 and FIG. 2, both of which will be discussed below.

The specific yarns utilized to yield the knit fabric in accordance with the present invention are corespun and cotton. Corespun yarn includes a core made of a resilient continuous filament yarn such as spandex, a synthetic yarn which has elastic properties superior to those of natural latex, though a natural latex can be used. Thus, the core of the corespun yarn imparts to the yarn and the resulting fabric a considerable degree of stretch and recovery. Of course, any resilient continuous filament yarn can comprise the core of the corespun yarn. Cotton fiber is then spun about the core to cover the core in its entirety. Thus, the core of a resilient continuous filament yarn is not exposed and will not come into contact with the cotton yarn with which the corespun yarn is knit.

It is therefore clear that the combination of yarns in accordance with the present invention renders a knit fabric having a large percentage of cotton, thus imparting to the fabric all the advantages and benefits of cotton. Yet, the fabric made with the present combination of yarns also possesses the desirable properties and characteristics of resilient yarns by virtue of the spandex core of the corespun yarn.

More specifically, the preferred embodiment of the corespun yarn in accordance with the present invention is comprised of approximately ninety percent (90%) cotton yarn and ten percent (10%) spandex yarn. Overall, the fabric knit with the cotton and corespun is ninety-seven percent (97%) cotton and three percent (3%) spandex, the cotton yarn comprising seventy percent (70%) of the fabric and the corespun yarn comprising thirty percent (30%) of the fabric. This high percentage of cotton facilitates the dyeing of the fabric as cotton is easily dyed in a single bath dyeing process. The high percentage of cotton is also soft next to the skin, and therefore more comfortable for an individual wearing clothes made from the fabric in accordance with the present invention.

Preferably, the corespun yarn is comprised of 70 denier LYCRA with a sheath of cotton that results in a yarn count of 30/1. LYCRA is a registered trademark of DuPont which is used in connection with their spandex yarn. The term "70 denier" denotes a unit of measure for LYCRA, representing a size ratio of the yarn. "Denier" indicates the weight of the yarn in grams per nine thousand meters of yarn. This unit of measure is not to be confused with the tex, a universal unit of measure indicating the weight of the yarn in grams of ten thousand meters of yarn. Thus, the preferred LYCRA yarn is seventy (70) grams per nine thousand meters. One skilled in the art will readily recognize that the larger the number of grams per nine thousand meters the bigger the yarn will be, thereby possessing greater strength and a larger measure of stretch and recovery—also referred to as "power."

The term "CP" cotton refers to combed peeler cotton which is comprised of relatively fine cotton fibers. The term "30/1" refers to the cotton count or size of the yarn as measured by an English measuring system. Specifically, "30/1" indicates that the cotton yarn is comprised of one strand of thirty (30) single yarn. "Thirty single" indicates that the strand of yarn is thirty grains per one hundred yards so that the larger the number preceding the word "single," the smaller the strand of yarn.

The cotton fiber with which the corespun is knit is a 60/2 gas mercerized cotton. From the foregoing, it is clear that a 60/2 cotton consists of two strands of sixty single yarn which are plied together by a lisle twist. The lisle twist utilizes either an S twist or a Z twist. The S or Z twist refers to the yarn twist direction in which the rear-side helical paths of a twisted yarn held in a vertical position comparable in direction of slope to the center portion of the respective letter, S or Z. The cotton is gas mercerized so as to improve the aesthetic appearance thereof as well as provide additional strength to the fabric. Gas mercerization is accomplished by treating the cotton fibers with strong caustic soda while the fibers are under tension. By so treating the fibers, the cotton becomes more lustrous, stronger and more readily dyeable. It is noted that the sheath of cotton covering the resilient yarn of the corespun yarn can also be gas mercerized. It is also recognized that the corespun yarn and the cotton yarn can be of approximately the same size.

FIG. 1 illustrates an example of the fabric in accordance with the present invention as stitched by the Swiss Pique stitch. While several other stitches are suitable to further the purposes and objects of the present invention, the Swiss Pique stitch has been found to be particularly suited when all factors such as cost and ease of manufacture are considered. The stitch in FIG. 1 is illustrated in a loose configuration, that is, prior to the tightening of the yarns to furnish the finished fabric 10. Thus, the specific structure of the stitch is easily observed by those skilled in the art, all of whom should be familiar with the Swiss Pique stitch as well as other stitches suitable for use with the combination of yarns in accordance with the present invention. Referring to the well-known Swiss Pique stitch in FIG. 1, those skilled in the art will readily recognize that the 60/2 gas mercerized cotton 20 will only be exposed on one side of the fabric 10, whereas both the 60/2 gas mercerized cotton 20 and the 30/1 corespun 30 will be exposed on the opposite side of the fabric 10. With respect to the knitting process on a double knit machine, the 60/2 mercerized cotton 20 will always be knit with both the cylinder and dial needles, while the 30/1 corespun 30 will be knit only with the dial needles.

FIG. 2 illustrates an example of the fabric in accordance with the present invention as stitched by the French Pique stitch, which has also been found to be particularly suited for the manufacture of the fabric of the present invention. Again, the 60/2 gas mercerized cotton 20 will only be exposed on one side of the fabric 10', whereas both the 60/2 gas mercerized cotton 20 and the 30/1 corespun 30 will be exposed on the opposite side of the fabric 10.

Figure 3:
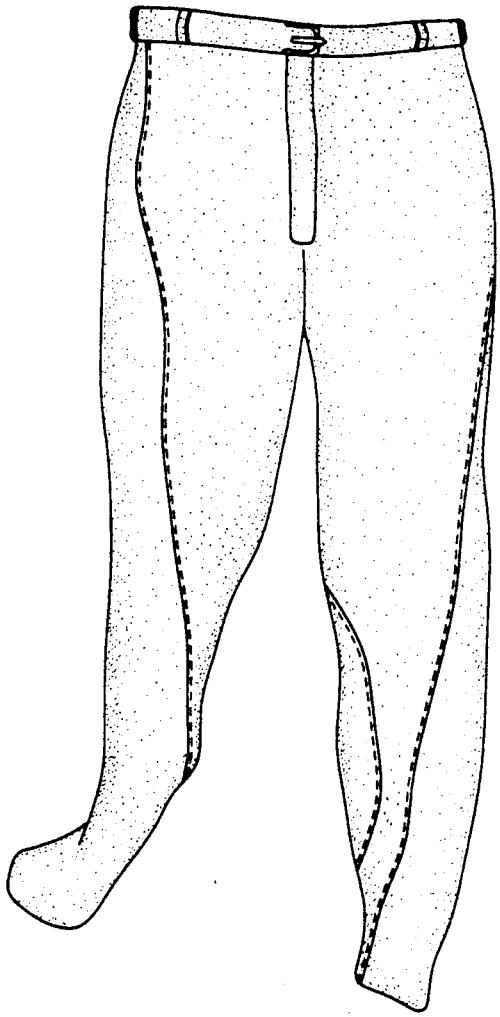
FIG. 3 is a front view of a pair of riding pants made in accordance with the present invention.

FIG. 3 illustrates a pair of riding pants which are made of a fabric in accordance with the present invention. Of course, the fabric of the present invention is intended for use in connection with any type of clothing, but is particularly suited for recreational clothing such as the riding pants depicted in FIG. 3.

While the foregoing description and figures illustrate one preferred embodiment of the knitted fabric in accordance with the present invention, it should be appreciated that certain modifications, such as the use of yarns other than the specific yarns disclosed or other stitches, it may be made in the structure of the knitted fabric without departing from the spirit and scope of the present invention which is defined by the claims set forth immediately hereafter.

What is claimed is:

1. A knit fabric for recreational clothing, said knit fabric comprising, a. a corespun yarn having a core of a resilient continuous filament yarn and a cotton fiber outer covering said core; and b. a cotton yarn knit with said corespun yarn by the Swiss Pique stitch so that only said cotton yarn is exposed on a first side of said fabric and a combination of said corespun yarn and said cotton yarn is exposed on a second side of said fabric, such that said fabric is substantially made up of cotton yet provides a high degree of recovery and strength for various recreational activities while being comfortable next to the skin of an individual.

2. The knit fabric claimed in claim 1, wherein said corespun yarn is made up of about 10% of said resilient continuous filament yarn and about 90% cotton fiber outer.

3. The knit fabric claimed in claim 1, wherein said corespun yarn comprises about 30% of said knit fabric and said cotton yarn comprises about 70% of said knit fabric.

4. The knit fabric claimed in claim 1, wherein said knit fabric comprises a total cotton content of about 97% and about 3% of said resilient continuous filament yarn.

5. The knit fabric claimed in claim 1, wherein said resilient continuous filament yarn is a spandex yarn.

6. The knit fabric claimed in claim 5, wherein said spandex yarn is approximately 70 denier.

7. The knit fabric claimed in claim 1, wherein said resilient continuous filament yarn is Lycra.

8. The knit fabric claimed in claim 1, wherein said resilient continuous filament yarn is a natural latex.

9. A knit fabric for recreational clothing, said knit fabric comprising, a. a corespun yarn having a core of a resilient continuous filament yarn and a cotton fiber outer covering said core; and b. a cotton yarn knit with said corespun yarn by the French Pique stitch so that only said cotton yarn is exposed on a first side of said fabric and a combination of said corespun yarn and said cotton yarn is exposed on a second side of said fabric, such that said fabric is substantially made up of cotton yet provides a high degree of recovery and strength for various recreational activities while being comfortable next to the skin of an individual.

10. The knit fabric claimed in claim 9, wherein said corespun yarn is made up of about 10% of said resilient continuous filament yarn and about 90% cotton fiber outer.

11. The knit fabric claimed in claim 9, wherein said corespun yarn comprises about 30% of said knit fabric and said cotton yarn comprises about 70% of said knit fabric.

12. The knit fabric claimed in claim 9, wherein said knit fabric comprises a total cotton content of about 97% and about 3% of said resilient continuous filament yarn.

13. The knit fabric claimed in claim 9, wherein said resilient continuous filament yarn is a spandex yarn.

14. The knit fabric claimed in claim 13, wherein said spandex yarn is approximately 70 denier.

15. The knit fabric claimed in claim 9, wherein said resilient continuous filament yarn is Lycra.

16. The knit fabric claimed in claim 9, wherein said resilient continuous filament yarn is a natural latex.

17. A pair of riding pants, said riding pants being made of a knit fabric comprising:

a. a corespun yarn having a core of a resilient continuous filament yarn and a cotton fiber outer covering said core; and b. a cotton yarn knit with said corespun yarn by the Swiss Pique stitch so that only said cotton yarn is exposed on a first side of said fabric and a combination of said corespun yarn and said cotton yarn is exposed on a second side of said fabric, such that said fabric is substantially made up of cotton yet provides a high degree of recovery and strength for various recreational activities while being comfortable next to the skin of an individual.

18. The riding pants claimed in claim 17, wherein said corespun yarn of said knit fabric is made up of about 10% of said resilient continuous filament yarn and about 90% of cotton fiber outer.

19. The riding pants claimed in claim 17, wherein said corespun yarn comprises about 30% of said knit fabric and said cotton yarn comprises about 70% of said knit fabric.

20. The riding pants in claim 17, wherein said knit fabric comprises a total cotton content of about 97% and about 3% of said resilient continuous filament yarn.

21. A pair of riding pants, said riding pants being made of a knit fabric comprising:

a. a corespun yarn having a core of a resilient continuous filament yarn and a cotton fiber outer covering said core; and b. a cotton yarn knit with said corespun yarn by the French Pique stitch so that only said cotton yarn is exposed on a first side of said fabric and a combination of said corespun yarn and said cotton yarn is exposed on a second side of said fabric, such that said fabric is substantially made up of cotton yet provides a high degree of recovery and strength for various recreational activities while being comfortable next to the skin of an individual.

22. The riding pants claimed in claim 21, wherein said corespun yarn of said knit fabric is made up of about 10% of said resilient continuous filament yarn and about 90% of cotton fiber outer.

23. The riding pants claimed in claim 21, wherein said corespun yarn comprises about 30% of said knit fabric and said cotton yarn comprises about 70% of said knit fabric.

24. The riding pants in claim 21, wherein said knit fabric comprises a total cotton content of about 97% and about 3% of said resilient continuous filament yarn.

25. A knit fabric for recreational clothing, said knit fabric comprising:

a. a first yarn having a core of a resilient continuous filament material covered by a non-elastic, absorbent and dyeable fiber outer; and b. a second yarn, said second yarn being non-elastic, absorbent and dyeable and being knit with said first yarn by the Swiss Pique stitch so that only said second yarn is exposed on one side of said knit fabric and a combination of said second yarn and said first yarn is exposed on the other side of said knit fabric, such that said knit fabric is substantially made up of non-elastic, absorbent and dyeable materials, yet provides a high degree of recovery and strength for various recreational activity.

26. A knit fabric for recreational clothing comprising:

a. a corespun yarn having a core of a resilient continuous filament yarn and a cotton fiber outer covering said core; and b. a cotton yarn knit with said corespun yarn by the Swiss Pique stitch so that only one of said cotton yarn or said corespun yarn is exposed on a first side of said fabric and a combination of said corespun yarn and said cotton yarn is exposed on a second side of said fabric, such that said fabric is substantially made up of cotton yet provides a high degree of recovery strength for various recreational activities while being comfortable next to the skin of an individual.

27. The fabric claimed in claim 26, wherein said knit fabric consists only of said corespun yarn and said cotton yarn.

28. A knit fabric for recreational clothing, said knit fabric comprising:

a. a first yarn having a core of a resilient continuous filament material covered by a non-elastic, absorbent and dyeable fiber outer; and b. a second yarn, said second yarn being non-elastic, absorbent and dyeable and being knit with said first yarn by the French Pique stitch to form a double knit structure wherein only one of said first yarn or said second yarn is exposed on one side of said knit fabric and a combination of said first yarn and said second yarn is exposed on the other side of said knit fabric, such that said double knit structure is substantially made up of a non-elastic, absorbent and dyeable material, yet said double knit structure alone provides, solely by virtue of the structure and arrangement of said first yarn and said second yarn, a high degree of recovery and strength.

29. The knit fabric claimed in claim 28, wherein said second yarn is made up of the same non-elastic, absorbent and dyeable material which covers said resilient continuous filament material.

30. The knit fabric claimed in claim 29, wherein said non-elastic, absorbent and dyeable fiber outer is cotton.

31. The knit fabric in claim 30, wherein said knit fabric consists only of said first yarn and said second yarn.

32. A knit fabric for recreational clothing comprising:

a. a corespun yarn having a core of a resilient continuous filament yarn and a cotton fiber outer covering said core; and b. a cotton yarn knit with said corespun yarn by the French Pique stitch so that only one of said cotton yarn or said corespun yarn is exposed on a first side of said fabric and a combination of said corespun yarn and said cotton yarn is exposed on a second side of said fabric, such that said fabric is substantially made up of cotton yet provides a high degree of recovery strength for various recreational activities while being comfortable next to the skin of an individual.

33. A pair of riding pants for a jockey of a race horse, said riding pants being made of a fabric comprising:

a. a corespun yarn having a core of a resilient continuous filament yarn and a cotton fiber outer covering said core; and b. a cotton yarn knit with said corespun yarn by the Swiss Pique stitch so that only one of said cotton yarn or said corespun yarn is exposed on a first side of said fabric and a combination of said corespun yarn and said cotton yarn is exposed on a second side of said fabric, such that said fabric is substantially made up of cotton yet provides a high degree of recovery strength for various recreational activities while being comfortable next to the skin of an individual.

34. The riding pants claimed in claim 33, wherein said knit fabric consists only of said corespun yarn and said cotton yarn.

35. A pair of riding pants for a jockey of a race horse, said riding pants being made of a fabric comprising:

a. a corespun yarn having a core of a resilient continuous filament yarn and a cotton fiber outer covering said core; and b. a cotton yarn knit with said corespun yarn by the French Pique stitch so that only one of said cotton yarn or said corespun yarn is exposed on a first side of said fabric and a combination of said corespun yarn and said cotton yarn is exposed on a second side of said fabric, such that said fabric is substantially made up of cotton yet provides a high degree of recovery strength for various recreational activities while being comfortable next to the skin of an individual.

36. A knit fabric for recreational clothing, said knit fabric comprising:

a. a first yarn having a core of a resilient continuous filament material covered by a non-elastic, absorbent and dyeable fiber outer; and b. a second yarn, said second yarn being non-elastic, absorbent and dyeable and being knit with said first yarn by the Swiss Pique stitch to form a double knit structure wherein only one of said first yarn or said second yarn is exposed on one side of said knit fabric and a combination of said first yarn and said second yarn is exposed on the other side of said knit fabric, such that said double knit structure is substantially made up of a non-elastic, absorbent and dyeable material, yet said double knit structure alone provides, solely by virtue of the structure and arrangement of said first yarn and said second yarn, a high degree of recovery and strength.

37. The knit fabric claimed in claim 36, wherein said knit fabric consists only of said first yarn and said second yarn.

38. A pair of riding pants, said riding pants being made of a knit fabric comprising:

a. a first yarn having a core of a resilient continuous filament material covered by a non-elastic, absorbent and dyeable fiber outer; and b. a second yarn, said second yarn being non-elastic, absorbent and dyeable and being knit with said first yarn by the Swiss Pique stitch to form a double knit structure wherein only one of said first yarn or said second yarn is exposed on one side of said knit fabric and a combination of said first yarn and said second yarn is exposed on the other side of said knit fabric, such that said double knit structure is substantially made up of a non-elastic, absorbent and dyeable material, yet said double knit structure alone provides, solely by virture of the structure and arrangement of said first yarn and said second yarn, a high degree of recovery and strength.

39. The riding pants claimed in claim 38, wherein said second yarn of said knit fabric is made up of the same non-elastic, absorbent and dyeable material which covers said resilient continuous filament material.

40. The riding pants in claim 39, wherein said non-elastic, absorbent and dyeable fiber outer is cotton.

41. The riding pants in claim 40, wherein said knit fabric consists only of said first yarn and said second yarn.

42. A pair of riding pants, said riding pants being made of a knit fabric comprising:

a. a first yarn having a core of a resilient continuous filament material covered by a non-elastic, absorbent and dyeable fiber outer; and b. a second yarn, said second yarn being non-elastic, absorbent and dyeable and being knit with said first yarn by the French Pique stitch to form a double knit structure wherein only one of said first yarn or said second yarn is exposed on one side of said knit fabric and a combination of said first yarn and said second yarn is exposed on the other side of said knit fabric, such that said double knit structure is substantially made up of a non-elastic, absorbent and dyeable material, yet said double knit structure alone provides, solely by virture of the structure and arrangement of said first yarn and said second yarn, a high degree of recovery and strength.

43. The riding pants claimed in claim 42, wherein said knit fabric consists only of said first yarn and said second yarn.

* * * * *

UNITED STATES PATENT AND TRADEMARK OFFICE

CERTIFICATE OF CORRECTION

PATENT NO. : 5,050,406

DATED : September 24, 1991

INVENTOR(S) : Strauss et al

It is certified that error appears in the above-identified patent and that said Letters Patent is hereby corrected as shown below:

Column 1, line 49, "relativley" should read --relatively--.

Signed and Sealed this

Thirteenth Day of April, 1993

*Attest:*

STEPHEN G. KUNIN

*Attesting Officer*

*Acting Commissioner of Patents and Trademarks*